United States Patent [19]

Osakabe

[11] Patent Number: 4,637,360

[45] Date of Patent: Jan. 20, 1987

[54] RECOIL STARTER

[75] Inventor: Mitsuo Osakabe, Tokyo, Japan

[73] Assignee: Starting Industry Company Limited, Tokyo, Japan

[21] Appl. No.: 707,034

[22] Filed: Mar. 1, 1985

[30] Foreign Application Priority Data

Mar. 12, 1984 [JP] Japan ..... 59-255411

[51] Int. Cl.[4] ..... F02N 5/02

[52] U.S. Cl. ..... 123/185 A; 123/185 B

[58] Field of Search ..... 123/179 SE, 185 A, 185 B, 123/185 BA, 185 R

[56] References Cited

U.S. PATENT DOCUMENTS 3,827,307 8/1974 Couchman, Jr. ..... 123/185 BA X 3,952,718 4/1976 Meyer ..... 123/179 SE 4,480,605 11/1984 Bloemers ..... 123/185 B X

*Primary Examiner*—Tony M. Argenbright

*Attorney, Agent, or Firm*—William J. Daniel

[57] ABSTRACT

A recoil starter composed of: a rotating reel which fits loosely around a supporting shaft in a housing, a cylindrical hub portion of the reel having a spiral spline which is integrally formed on its inner periphery; a clutch cylinder which is loosely inserted into the cylindrical hub portion and carries a spline groove for such engagement with the hub spline whereby relative rotation of the reel hub and clutch cylinder causes axial projection and retraction of the clutch cylinder; and clutch projections which are provided at the free end of the clutch cylinder such as to project and engage recesses integral with a flywheel on the associated engine. Inside the clutch cylinder at its bottom a stepped portion is provided where an axial notch is formed. A coiled spring is loosely fitted around the supporting shaft, and compressed and frictionally restrained by a fixed washer against free rotation which frictional resistance is applied to the clutch cylinder either directly via a hooked end of the coiled spring loosely inserted into the notch inside the clutch cylinder or indirectly through a collar keyed to the notch. In order to prevent the clutch cylinder from projecting when the engine has started, the axial notch includes a lateral extension to resemble an L, the extension projecting peripherally with respect to the axial direction.

8 Claims, 10 Drawing Figures

RECOIL STARTER

BACKGROUND OF THE INVENTION

This invention relates to a recoil starter which is used as a starting apparatus for an air-cooled internal engine or the like. A conventional recoil starter of this kind has, as is disclosed in Japanese Utility Model Publication No. 48778/1980, which was published on Nov. 14, 1980, or in Japanese Utility Model Publication No. 7088/1983, which was published on Feb. 7, 1983, a structure in which a reel is rotated by pulling a cord so as to project in the radial direction a clutch claw which is bolted to a disc, and the clutch claw is engaged with the through hole of a cylindrical portion which is directly connected to an engine, whereby the engine is rotated.

However, since, in the structure described above, the cylindrical portion on the engine side is overlaid on the peripheral surface of the clutch portion in such a way that the cylindrical portion covers the clutch portion, it is inconveniently difficult to draw air for cooling the engine, and, in addition, a complicated structure is required in the driving portion on the engine side.

SUMMARY OF THE INVENTION

Accordingly it is an object of the invention to remove such drawbacks as described above.

To this end, this invention provides a recoil starter which rotates an engine by the rotation of a reel rotated by pulling a coil and which has the following structure:

A rotating reel fits loosely around a supporting shaft which is provided in a housing and a cylindrical portion which has a plurality of teeth or a spiral spline is integrally installed on the inner periphery of the reel. A clutch cylinder which also has a spline is loosely inserted into the cylindrical portion such that they engage each other. A gear or clutch claws are provided at the fore end of the clutch cylinder such as to project and engage a plurality of projections or a gear, the projections or gear being integral with a flywheel which is attached to the end portion of the crankshaft of an engine. In the inside of the clutch cylinder at the bottom a stepped portion is provided where a notch is formed in the axial direction. A coiled spring is loosely fitted around the supporting shaft, and compressed and retained such that a protrusion which is indirectly or directly connected to the coiled spring is loosely inserted into the notch inside the clutch cylinder.

This invention provides a recoil starter which is different from the one described above in that the notch which is formed in the clutch cylinder is formed in an L-shape, one side of the L-shape being orthogonal to the other side which is disposed in the axial direction of the clutch cylinder and in that the protrusion is brought into contact with the bottom portion of the L-shaped notch in order to prevent the clutch cylinder from projecting again by virtue of inertia when the cord is released.

In a recoil starter having this structure, when a cord is first pulled, a reel is rotated against the force of the recoil spring, whereby the clutch cylinder which is engaged with the cylindrical portion would begin to rotate. However, since rotation of the protrusion which is loosely inserted into the notch is checked by the compression spring, the clutch cylinder is pushed out in the axial direction by the spline, and the clutch claws engage the projections or the gear of the flywheel.

Then the clutch cylinder is stopped from projecting and the protrusion starts to rotate together with the compression spring, thereby starting the engine. When the engine has started to rotate, the clutch cylinder is drawn in the axial direction by the spline. When the cord is released, the cord is rewound around the reel by the recoil spring.

In a recoil starter having the structure just described, when the cord is released, the reel is suddenly unwound and finally comes to a sudden stop. Therefore when the clutch cylinder is completely contained into the cylindrical portion, it would begin to rotate by virtue of inertia, and hence, it would begin to project again by the action of the spline. However, at this time the protrusion comes into contact with the bottom portion of the L-shaped notch, which prevents the clutch cylinder from projecting again.

The above and other objects, features and advantages of the present invention will become clear from the following description of the preferred embodiments thereof, taken in conjunction with the accompanying drawings.

BRIEF DESCRIPTION OF THE DRAWINGS

FIGS. 6, 7 and 8 are fragmentary views of the interior of the clutch cylinder of FIG. 5 showing in step by step sequence operation of that cylinder.

DESCRIPTION OF THE PREFERRED EMBODIMENTS

Figure 1:
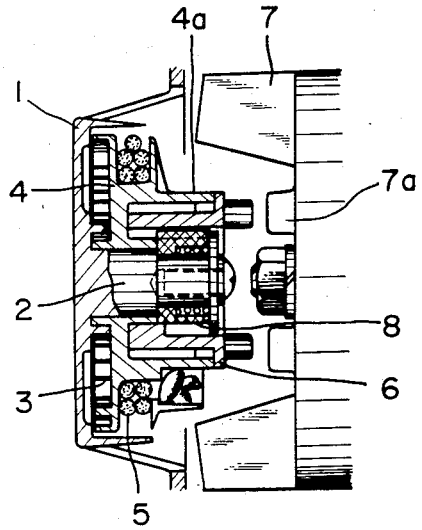
FIG. 1 is a sectional view of an embodiment of a recoil starter according to the invention.
Figure 2:
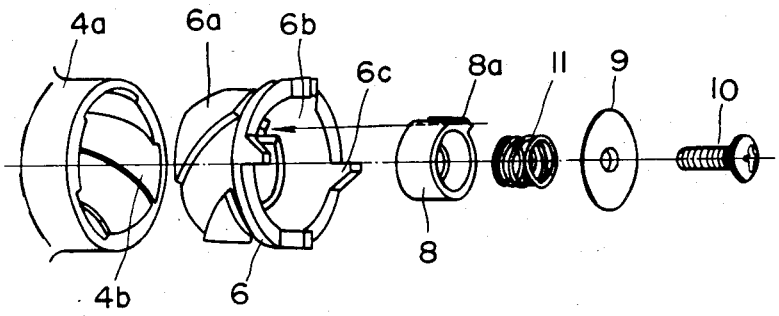
FIG. 2 is an exploded view in perspective of the main part of the embodiment shown in FIG. 1.
Figure 3:
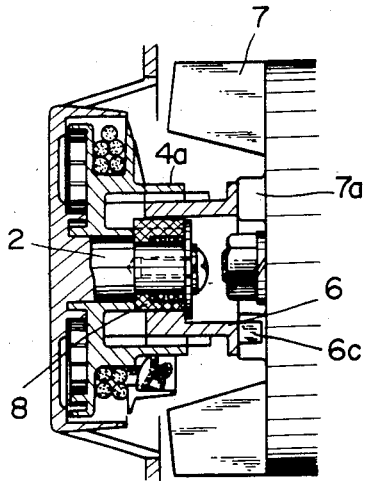
FIG. 3 is a sectional view of the embodiment in the operative state.
Figure 3A:
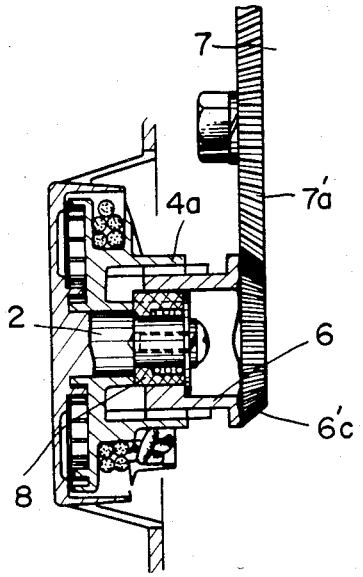
FIGS. 3A and 3B are sectional views of other embodiments.
Figure 3B:
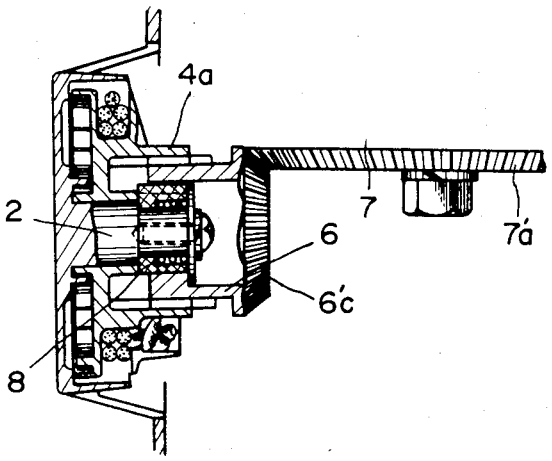

FIG. 1 is a sectional view of an embodiment of this invention, and FIG. 2 is an exploded view in perspective of the main part of the embodiment. As is shown in FIG. 1, in a housing 1, a supporting shaft 2 is integrally provided being surrounded by a recoil spring 3. One end of the recoil spring is secured to the supporting shaft 2 and the other end to a reel 4 which fits loosely around the supporting shaft 2. A cord 5 is wound around the reel 4, with one end thereof secured to the reel 4 and the other extending to the outside of the housing 1 (not shown) with a knob attached thereto. An axially directed hollow cylindrical portion **4*a* is integrally formed on reel 4 and in its interior wall a plurality of teeth or a spiral spline 4*b* is formed. A clutch cylinder 6 having a spline 6*a* which engages this spline 4*b* is situated within the cylindrical portion 4*a*. The clutch cylinder 6 has a stepped portion on its interior adjacent its bottom portion, and an axial notch 6*b* is formed in the stepped portion. A plurality of clutch claws 6*c* are integrally provided at the fore end of the clutch cylinder 6 in the positions which correspond in the axial direction to the positions of projections 7*a* (FIG. 3) which are integrally provided in a flywheel 7** attached to the end portion of the crankshaft of an engine, such that claws 6c can engage and mesh with the projections 7a. If the flywheel 7 is arranged with its plane in a position orthogonal to the axis of clutch cylinder 6, as in FIG. 3B, or in a position which is eccentric in relation to the clutch cylinder 6, as in FIG. 3A, it is possible to provide gear teeth 7'a around the outer periphery of the end of the flywheel 7 and gear teeth 6'c which are engagable with the gear teeth 7'a around the outer periphery of the fore end of the clutch cylinder 6 instead of providing the projections 7a and the clutch claws 6c. These sets of gear teeth become engaged when cylinder 6 is projected axially.

Further, a cylindrical clutch guide collar 8 is loosely fitted around the supporting shaft 2 coaxial with cylinder 6, and a radially directed protrusion 8a which is integrally formed on the outer periphery of the clutch guide collar 8 is loosely engaged in the notch 6b of the clutch cylinder 6. The clutch cylinder 6 is installed in such a manner as to be axially slidable in relation to the clutch guide 8. The clutch guide 8 is retained on a stepped portion at the free end of the supporting shaft 2 by a washer 9 and a screw 10 such as to be only rotatable, but the rotation of the clutch guide is resisted by a coiled spring 11 which is inserted into the stepped space between the supporting shaft 2 and the clutch guide 8. However, if turning force more than the resistance or braking force of the compression spring 11 is applied, the clutch guide 8 will rotated.

The operation in the above-described structure will be described.

When cord 5 is first pulled, reel 4 is rotated against the resistance of the recoil spring 3, whereby the clutch cylinder 6 would begin to rotate. However, since rotation of the clutch guide 8 is checked by the compression spring 11, the clutch cylinder 6 is projected out in the axial direction (rightwardly in the drawing) by the spline 4b by the relative rotation of reel 4. Therefore the clutch claws 6c engage and mesh with the projections 7a or the clutch cylinder gear teeth engages with those of the flywheel 7. Then the clutch cylinder 6 is prevented from further projection and the resistance of coil spring 3 overcomes the braking force of washer 9, and the clutch guide 8 starts to rotate, thereby starting the engine. When the engine has fired and started to rotate, the clutch cylinder 6 is retracted in the axial direction by the spline 6a. When the cord 5 is released, the cord 5 is rewound around the reel 4 by the recoil spring 3, whereby the recoil starter is restored to its initial state.

Figure 4:
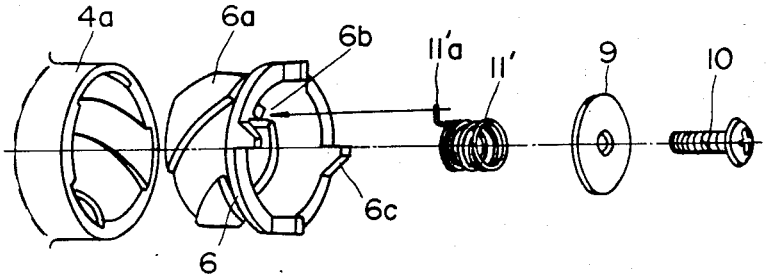
FIG. 4 is an exploded view in perspective of the main part of the embodiment shown in FIG. 1 for which another embodiment of a clutch guide is used.

In the above embodiment, the clutch guide 8 is frictionally restrained by the compression spring 11 via washer 9, but the clutch guide 8 can be omitted and the same effect obtained by a compression spring 11' one end of which is bent to form a projection 11'a, as is shown in FIG. 4 for anchoring in clutch cylinder 6. In this case, the compression spring 11' can be rotated together with the projection 11'a. This compression spring 11' allow the diameter of the clutch cylinder 6 to be reduced and facilitates introduction of air.

Figure 5:
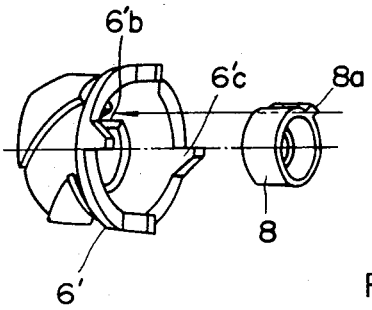
FIG. 5 is an exploded view in perspective of the main part of another embodiment of a clutch cylinder.

When the knob (not shown) attached to the cord 5 is released in retracting the pulled cord 5, the reel 4 is rotated by the recoil spring 3 to rewind the cord 5, and when the knob abuts against the housing 1, the reel 4 and the cylindrical portion which is integral with the reel 4 are brought to a sudden stop. At this moment the clutch cylinder 6 shows a tendency to rotate further by virtue of inertia, and would begin to project again by the action of the spline 4b. In order to prevent this, in a clutch cylinder 6' the notch 6'b is formed in an L-shape such a manner that it has one straight leg in the axial direction with its other side extending peripherally at a right angle to the first side, as is shown in FIG. 5.

Figure 6:
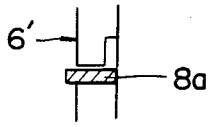
Figure 6:
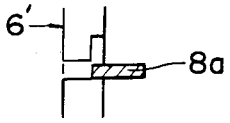
Figure 6:
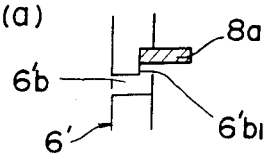

This L-shaped notch prevents the unnecessary projection of the clutch guide because the protrusion 8a of the clutch guide 8 comes into contact with the bottom portion 6'b1 of the L-shaped notch 6'b, as is shown in FIG. 6(a). At the starting time (the state shown in FIG. 6(a)), when the reel 4 starts to rotate, the clutch cylinder 6' would begin to project, but since it is in contact with the protrusion 8a of the clutch guide 8 it begins to rotate without projecting. When the clutch cylinder 6 is rotated up to the position of the notch 6'b (the state shown in FIG. 6(b)), the clutch cylinder 6' assumes the ability to project and begins to do do (FIG. 6(c)). In the case of releasing the cord 5, when the clutch cylinder 6' has been completely received by the cylindrical portion 4a, the protrusion 8a of the clutch guide 8 fits into the bottom portion 6'b1 of the notch 6'b, and the clutch guide 8 continues to rotate in this state until the cord 5 is restored, thereby finishing the starting operation (FIG. 6(a)). This prevents the clutch cylinder 6' from projecting due to the vibration of the engine or the like, and even if the knob is released, the clutch claws 6'c do not come into contact with the projections 7a, which leads to less trouble developing.

As described above, the present invention is advantageous in that, since the diameter of the clutch is smaller than a conventional one, it is easy to introduce air for cooling the engine, in that the structure of the driving portion of the engine is simplified and can be manufactured at a low cost. To sum up, according to the invention, a trouble-free recoil starter can be obtained at a low price.

While there has been described what are at present considered to be the preferred embodiments of the invention, it will be understood that various modifications may be made therein, and it is intended that the appended claims cover all such modifications as fall within the true spirit and scope of the invention.

What is claimed is:

1. A recoil starter comprising:

a supporting shaft mounted within a housing;

a reel which is loosely fitted for rotation around said supporting shaft;

a cylindrical hub portion carried integrally by said reel;

a clutch cylinder loosely fitted in coaxial relation on said cylindrical hub portion, said hub portion and said cylinder having a cooperating spiral spline and groove connection whereby relative rotation causes axial projection and retraction of said clutch cylinder;

a plurality of generally axial projections provided at the fore end of said clutch cylinder in a position opposing a plurality of recesses provided integrally with a flywheel which is attached to the end portion of a crankshaft of an engine, for engagement upon projection of said clutch cylinder;

an axially extending notch on said clutch cylinder extending part of the axial length thereof;

means mechanically engaged in said notch to permit relative axial displacement of said clutch cylinder; and friction means acting on said notch engaging means to brake the same against rotation and thus the clutch cylinder to thereby effect relative rotation of said hub portion and clutch cylinder to project the latter into flywheel engaging position.

2. The recoil starter of claim 1 wherein said clutch cylinder is provided on its interior with a stepped section and said axially extending notch is formed in said stepped section.

3. The recoil starter of claim 1 wherein said means mechanically engaging in said notch is a collar coaxially supported on said shaft for rotation thereon, said collar being disposed between said shaft and the interior of said clutch cylinder and carrying a radially projecting key in sliding engagement with the notch in said clutch cylinder to permit relative axially displacement therebetween.

4. The recoil starter of claim 3 including a friction element in resilient engagement with a surface of said collar to restrain the free rotation thereof.

5. The recoil starter of claim 1 wherein said means mechanically engaged in said notch takes the form of a radial projection in a coil spring loosely surrounding said shaft within the interior of said clutch cylinder.

6. The recoil starter of claim 5 wherein said frictional means comprises a friction member in resilient engagement with said coil spring to resist the free rotation thereof around said shaft.

7. The recoil starter of claim 1 including means operative when said recoil starter has returned to its inoperative position with said clutch cylinder in its retracted position after the starting of the engine associated therewith for inhibiting said clutch cylinder against further relative rotation with respect to said reel hub portion.

8. The recoil starter of claim 7 wherein said inhibiting means comprises a peripherally extending leg on said notch for engaging said means mechanically engaged in said notch to temporarily prevent axial displacement of the clutch cylinder when the latter is in overrunning condition following starting of the associated engine.

* * * * *

UNITED STATES PATENT AND TRADEMARK OFFICE

CERTIFICATE OF CORRECTION

PATENT NO. : 4,637,360

DATED : January 20, 1987

INVENTOR(S) : Mitsuo Osakabe

It is certified that error appears in the above-identified patent and that said Letters Patent is hereby corrected as shown below:

In the Heading:

Item [30] Foreign Application Priority Data should read:

-- Dec. 3, 1984 [JP] Japan..... 59-255441 --.

Signed and Sealed this

Twenty-first Day of April, 1987

*Attest:*

DONALD J. QUIGG

*Attesting Officer*

*Commissioner of Patents and Trademarks*